US006037911A

United States Patent [19]

Brankovic et al.

[11] Patent Number: 6,037,911

[45] Date of Patent: Mar. 14, 2000

[54] WIDE BANK PRINTED PHASE ARRAY ANTENNA FOR MICROWAVE AND MM-WAVE APPLICATIONS

[75] Inventors: Veselin Brankovic, Fellbach, Germany; Aleksandar Nesic, Novi Beograd, Yugoslavia

[73] Assignee: Sony International (Europe) GmbH, Koln, Germany

[21] Appl. No.: 09/106,989

[22] Filed: Jun. 29, 1998

[30] Foreign Application Priority Data

Jun. 30, 1997 [EP] European Pat. Off. ..... 97110678
Jun. 30, 1997 [EP] European Pat. Off. ..... 97110679

[51] Int. Cl.[7] ..... H01Q 9/28

[52] U.S. Cl. ..... 343/795; 343/700 MS

[58] Field of Search ..... 343/795, 853, 343/810, 700 MS, 814, 816, 815, 817, 818, 819, 820, 821, 822; 5/795; H01Q 9/28

[56] References Cited

U.S. PATENT DOCUMENTS

| | | | |
|---|---|---|---|
| 3,587,110 | 6/1971 | Woodward | 343/813 |
| 3,681,769 | 8/1972 | Perrotti et al. | 343/814 |
| 3,887,925 | 6/1975 | Ranghelli | 343/795 |
| 4,054,874 | 10/1977 | Oltman, Jr. | 343/700 |
| 4,719,470 | 1/1988 | Munson | 343/700 |
| 4,758,843 | 7/1988 | Agrawal et al. | 343/814 |
| 5,319,377 | 6/1994 | Thomas et al. | 343/700 MS |
| 5,440,318 | 8/1995 | Butland et al. | 343/814 |
| 5,708,446 | 1/1998 | Laramie | 343/815 |

FOREIGN PATENT DOCUMENTS

| | | | |
|---|---|---|---|
| 1012888 | 6/1962 | United Kingdom | H01Q 21/12 |

*Primary Examiner*—Don Wong
*Assistant Examiner*—Shih-Chao Chen
*Attorney, Agent, or Firm*—Frommer Lawrence & Haug, LLP.; William S. Frommer

[57] ABSTRACT

The present invention relates to a phase array antenna comprising a dielectric substrate (1) comprising a front and a back dielectric face (2, 3), a plurality of dipole means (4), each comprising a first and a second element (5, 6) for radiating and receiving electromagnetic signals, said first elements (5) being printed on said front face and pointing in a first direction and said second elements (6) being printed on said back face (3), and pointing in a second direction opposite to said first direction, metal strip means (7) for supplying signals to and from said dipole means (4), said metal strip means (7) comprising a first line (8) printed on said front face (2) and coupled to said first element (5) and a second line (9) printed on said back face (3) and coupled to said second element (6), and reflector means (10) spaced to and parallel with said back face (3) of said dielectric substrate (1), a low loss material (11) being located between said reflector means (10) and said back face (3), and having a dielectric constant less than 1.2, whereby said first and second lines (8, 9) respectively comprise a plurality of first and second line portions (13, 14), said first and second line portions (13, 14) respectively being connected to each other by T-junctions (15), whereby each of said first and second line portions (13, 14) is tapered between two adjacent T-junctions (15), so that the width of each line portion (13, 14) increases towards said first and second elements (5, 6), respectively, to provide an impedance transformation in the succeeding T-junction (15). The present invention relates to a low cost wide band planar printed antenna solution for microwave and mm-wave range. A particular solution for 60 GHz is introduced.

21 Claims, 8 Drawing Sheets

WIDE BANK PRINTED PHASE ARRAY ANTENNA FOR MICROWAVE AND MM-WAVE APPLICATIONS

BACKGROUND OF THE INVENTION

1. Field of the Invention

The present invention relates to a phase array antenna comprising a plurality of dipole means according to claim 1.

2. Description of the Related Art

A dipole antenna is known from U.S. Pat. No. 5,021,799. This US-patent discloses a dipole antenna, in which the first line and a second line of a microstrip transmission line means are tapered to provide a microstrip-to-balanced line impedance transformation. Further on, the first and the second line are separated in the direction of the dielectric substrate middle plane, form an electric field and provide an impedance transformation from an unbalanced line part of the microstrip transmission line means to first and second balanced dipole antenna elements. Therefore, in the antenna disclosed in U.S. Pat. No. 5,021,799, the transformation from unbalanced to balanced transmission is conducted within microstrip transmission line means of the dipole antenna. Also, this antenna is inherently selective (not wide band) due to the classic dipole microstrip structure. Further on, this known antenna is tolerance sensitive. The thickness of the substrate of this known antenna is 0.0125 wavelength, that would lead for the 60 GHz range to a thickness of 0.0625, which is very thin and critical to be manufactured and handled. However, due to the specific structure of the dipole antenna disclosed in U.S. Pat. No. 5,021,799, the dipole antenna can be mainly applied for narrow band applications. The manufacturing tolerances, increased losses in dielectric material, decreasing of the substrate thickness, supporting the substrate with the same distance to the reflector plane, as well as possible appearance of the high order modes limits its application in the lower microwave range (3–30 GHz).

U.S. Pat. No. 4,737,797 discloses a dipole antenna without a reflector plane. This dipole antenna comprises a transmission part within the microstrip transmission line means, in which signals are converted from an unbalanced line to a balanced line to permit the signal to be radiated by first and second balanced dipole elements. The dipole antenna disclosed in U.S. Pat. No. 4,737,797 exhibits a wide band width up to 1.7 GHz (about 30%). However, the dipole antenna does not allow applications up to the millimeter wave range, because of very critical tolerances (thin traces) for balun-circuits and very thin substrates (like 0.024 mm for 60 GHz), where a physical support of the structure (robustness) and availability of such small dielectric thickness is questionable.

SUMMARY OF THE INVENTION

Therefore, the object of the present invention is to provide a phase array antenna, which allows applications deep into millimeter wave frequencies within a very large band width with a good efficiency.

This object is achieved by a phase array antenna with the features of claim 1 and by an antenna according to claim 11. The antenna according to the present invention comprises a dielectric substrate comprising a front and a back dielectric face, a plurality of dipole means, each comprising a first and a second element for radiating and receiving electromagnetic signals, said first elements being printed on said front face and pointing in a first direction and said second elements being printed on said back face, and pointing in a second direction opposite to said first direction, metal strip means for supplying signals to and from said dipole means, said metal strip means comprising a first line printed on said front face and coupled to said first element and a second line printed on said back face and coupled to said second element, and reflector means spaced to and parallel with said back face of said dielectric substrate, a low loss material being located between said reflector means and said back face and having a dielectric constant less than 1.2, whereby said first and second lines respectively comprise a plurality of first and second line portions, said first and second line portions respectively being connected to each other by T-junctions, whereby each of said first and second line portions is tapered between two adjacent T-junctions, so that the width of each line portion increases towards said first and second elements, respectively, to provide an impedance transformation in the succeeding T-junction.

The antenna according to the present invention has a very large band width and allows applications deep into the millimeter wave frequency range. Due to the tapered lines, an impedance transformation from some specific impedance of the feeding network is achieved, so that an antenna with a good efficiency and a high gain is provided. Further on, the antenna according to the present invention can be fabricated at very low production costs, e.g. due to the utilization of a simple planar technology, utilization of a printed technology and/or simple and cheap photolithographic processing of the prints. Further on, the antenna according to the present invention can be produced with a small size and a high reproducibility due to a low tolerance sensitivity of the dipole antenna. Also, a simple integration with planar RF-assemblies is possible, since it is assumed that future microwave and millimeter wave technologies will be based on planar assemblies rather than waveguide technology. A big advantage of the antenna according to the present invention is the possibility to use the same antenna for different kinds of communication systems even at different frequency bands of interest. Possible identified mass market applications are e.g. broad band home networks, wireless LAN, private short radio links, automotive millimeter wave radars, microwave radio and TV distribution systems (transmitters and ultra low cost receivers). Some of the identified frequency bands of interest are: 5 GHz, 10.5 GHz, 17–19 GHz, 24 GHz, 26–27 GHz, 28 GHz, 40 GHz, 51 GHz, 59–64 GHz, 76 GHz and 94 GHz. At the same time the antenna according to the present invention satisfies the following general requirements, namely has a specific radiation pattern, a good matching in the frequency band of interest and a good efficiency in the frequency band of interest.

Particular advantages of the antenna according to the present invention compared to known dipole antennas are explained in the following. The antenna according to the present invention has a very large band width of more than 30% working range compared to known microstrip dipole antennas. Therefore, a same antenna according to the present invention can be used for different systems and different applications. Further on, the production tolerances of different parts of the antenna according to the present invention are much less critical than for known microstrip dipole antennas, which is very important for the frequencies in the microwave and the millimeter wave ranges. Due to its particular structure, the antenna according to the present invention has lower losses and sensitivity to higher order modes propagation at higher frequencies (microwave range and mm-wave range) compared to known microstrip dipole antennas. Due to the low tolerance sensitivity of the antenna according to the present invention, the manufacturing particularly for millimeter wave frequency ranges is much less critical. The higher unwanted higher order modes in the case of the microstrip line appear at lower frequencies compared to a balanced microstrip line printed on a substrate with the same thickness. Further on, in the antenna according to the present invention the influence of the feeding network on the radiation pattern, is much lower, due to the balanced microstrip feeding line structure, than in known microstrip dipole antennas. The required dielectric substrate thickness for an optimum working scenario (small losses in wanted radiation pattern) is very small in the case of known microstrip dipole antennas. The thickness of the dielectric substrate is not so critical for the antenna according to the present invention, so that the antenna according to the present invention is easier and cheaper to produce. A further very large advantage of the antenna according to the present invention is the feasible maximum frequency of operation, which can be achieved by producing the antenna with commercial low cost photo lithography technology. The feasible maximum frequency of the antenna according to the present invention is 94 GHz and 140 GHz with a dielectric thickness of about 50 $\mu$m (commercially available) and an advanced photolithographic technology. The feasible maximum frequency of known microstrip dipole antennas is 40 GHz and 60 GHz with a very advanced technology and problems in reproducibility. Therefore, the antenna according to the present invention provides a low cost wide band antenna having not critical tolerances particularly suitable for microwave and millimeter wave applications.

Further advantageous features of the antenna according to the present invention are defined in the subclaims.

Advantageously, the width of each of the line portions gradually increases to provide an impedance transformation of a ratio 1:2 in the succeeding T-junction. The line portions can thereby be tapered corresponding a linear, exponential or polynomial function. Advantageously, the low loss material is a supporting structure supporting said reflector means and said back face. Further on, said first and second lines and said T-junctions can advantageously be balanced and arranged parallel and opposite to each other on said front and back dielectric face, respectively.

Advantageously, the length of said first and second elements is respectively smaller than 0.5 $\lambda$ the mean width w of the respective element is smaller than 0.35 $\lambda$ and the width c of a contact area between said respective element and said first or second line coupled to said respective element is smaller than 0.1 $\lambda$, whereby $\lambda$ is the free space wavelength of the center frequency of the band of interest, the angle between the respective line and each of the adjacent sides of the respective element being larger than 10 degrees. Thereby, said first and second elements can have a structure comprising at least three corners, whereby said contact area is one of said corners. Advantageously, said first and second elements have a pentagonal shape. Further on, the distance of the reflector means to the middle of said dielectric substrate means is approximately one fourth of the electrical wavelength of the working band frequency within said low loss material. Advantageously, the antenna of the present invention has a transition element coupled to said first and second lines to provide a transition between said first and second lines and a waveguide for guiding signals to and from the antenna, said transition element comprising first teeth elements coupled to said first line and second teeth elements coupled to said second line, said first teeth elements pointing in a first direction and said second teeth elements pointing in a second direction opposite to said first direction, said first and said second direction being perpendicular to said first and second lines.

BRIEF DESCRIPTION OF THE DRAWINGS

The present invention will in the following be explained in more detail by means of a preferred embodiment under reference to the enclosed drawings, wherein.

DETAILED DESCRIPTION OF THE INVENTION

Figure 1:
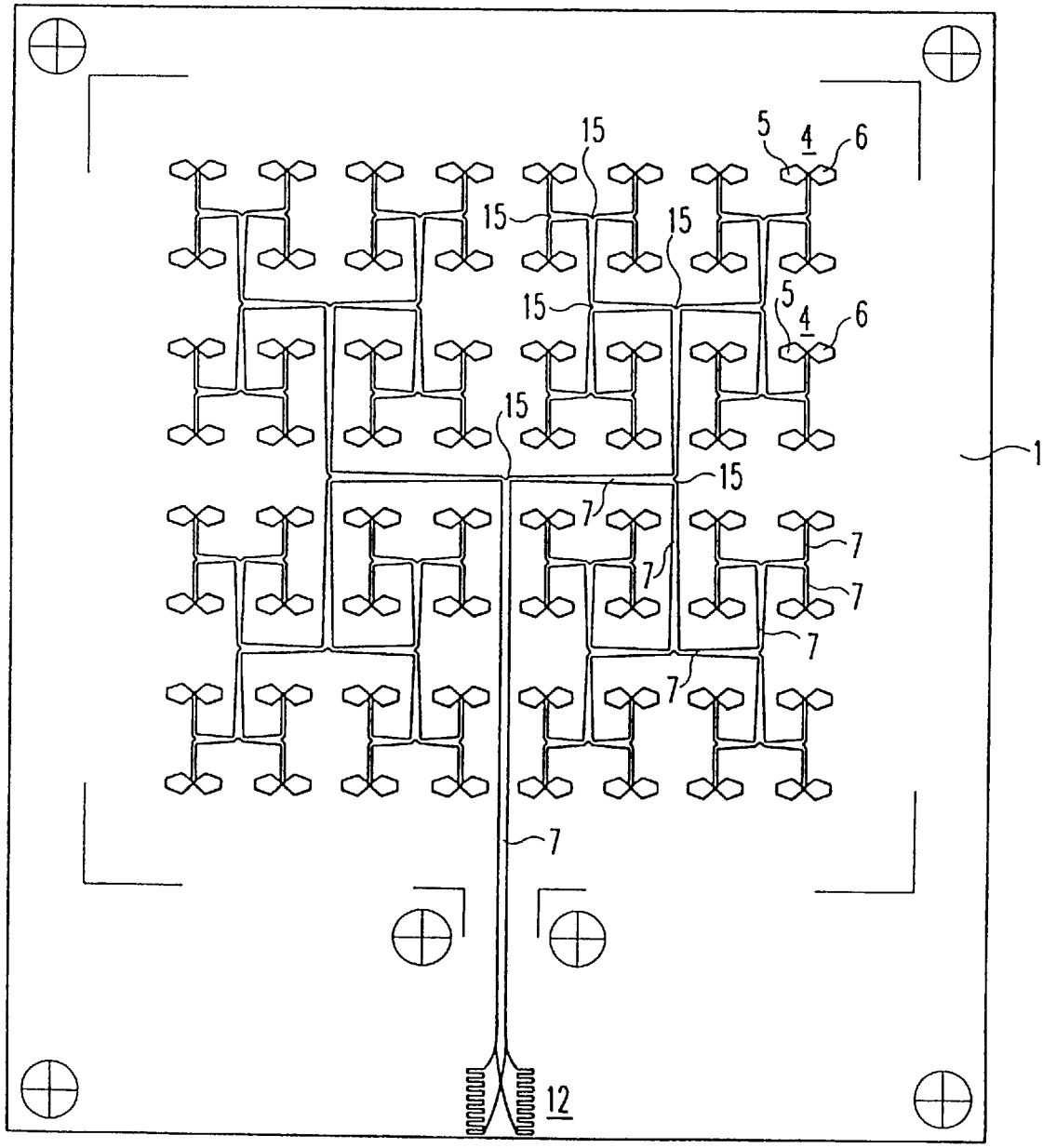
FIG. 1 shows a schematic upper view of a phase array antenna according to the present invention projected in the same plane.

FIG. 1 shows a schematic upper view of an antenna according to the present invention, with a projection of metal strip means 7 and a plurality of dipole means 4 from a front face 2 and a back face 3 of the dielectric substrate means 1 in a common plane. In the antenna according to the present invention, the first elements 5 of the dipole means 4 are printed on the front face 2 of the dielectric substrate means 1 and the second elements 6 of the dipole means 4 are printed on the back face 3 of the dielectric substrate means 1. The first elements 5 are connected to each other with a first line 8 supported by the front face 2 for supplying signals to and from the first elements 5. The second elements 6 are coupled to each other with a second line 9 supported by the back face 3 for supplying signals to and from said second elements 6. In the example shown in FIG. 1, the first line 8 and the second line 9 building the metal strip means 7 have a balanced microstrip structure and are connected to a waveguide transition element 12 near the edge of the dipole antenna to provide a transition between the balanced lines 8 and 9 to a waveguide supplying the signals to be radiated by the dipole means 4. The waveguide transition element 12 consists of two parts connecting each of the lines 8 and 9 to a waveguide. Each of the two parts of the waveguide transition element 12 comprises a plurality of teeth elements arranged perpendicular to the direction of the lines 8, 9 on the front face 2 and the back face 3, respectively. It is to be noted, that future commercial communication systems in microwave and millimeter wave ranges will be based on planar technology, so that other kinds of transition elements will be needed. The waveguide transition element 12 is important for the shown example due to the lack of a planar front end.

In FIG. 1, the first line 8 and the second line 9 respectively printed on the front face 2 and the back face 3 each split into two branches by means of a T-junction 15 located approximately in the middle of the antenna. From the first T-junction 15 located approximately in the middle of the antenna, succeeding T-junctions 15 being respectively rectangular to each other split the first line 8 and the second line 9 into a respective plurality of first line portions 13 and second line portions 14. Each line portion 13 is connecting two adjacent T-junctions 15 and each second line portion 14 is also connecting two adjacent T-junctions 15.

As can be seen from FIG. 1, the structure of the first and second line portions 13, 14 and the succeeding T-junctions 15 is symmetrical for the two branches. Further on, respective adjacent first and second line portions 13 and 14 are rectangular to each other. After the last T-junctions 15, respective end portions of the first line 8 and the second line 9 lead into dipole means 4. Each dipole means 4 comprises a first and a second element 5, 6 for radiating and receiving electromagnetic signals transmitted by the first line 8 and the second line 9. The first elements 5 are printed onto the front face 2 of the dielectric substrate 1 and the second elements 6 are printed onto the back face 3 of the dielectric substrate 1. The first and the second elements 5, 6 respectively extend generally perpendicular to the first or second line portion 13, 14 they are connected with. Further on, the first elements 5 are pointing in a first direction and the second elements 6 are pointing in a second direction which is opposite to that first direction, as can be seen from FIG. 1. The preferred shape of the first and the second elements 5 and 6 is a pentagonal shape. As can be further seen in FIG. 1, the first line portions 13 and the second line portions 14 between adjacent T-junctions 15 are tapered to provide an impedance transformation in the succeeding T-junction located in direction to the dipole means 4. The first and second line portions 13, 14 are tapered, so that the width of each line portion 13, 14 increases towards that first and second elements.

Figure 2:
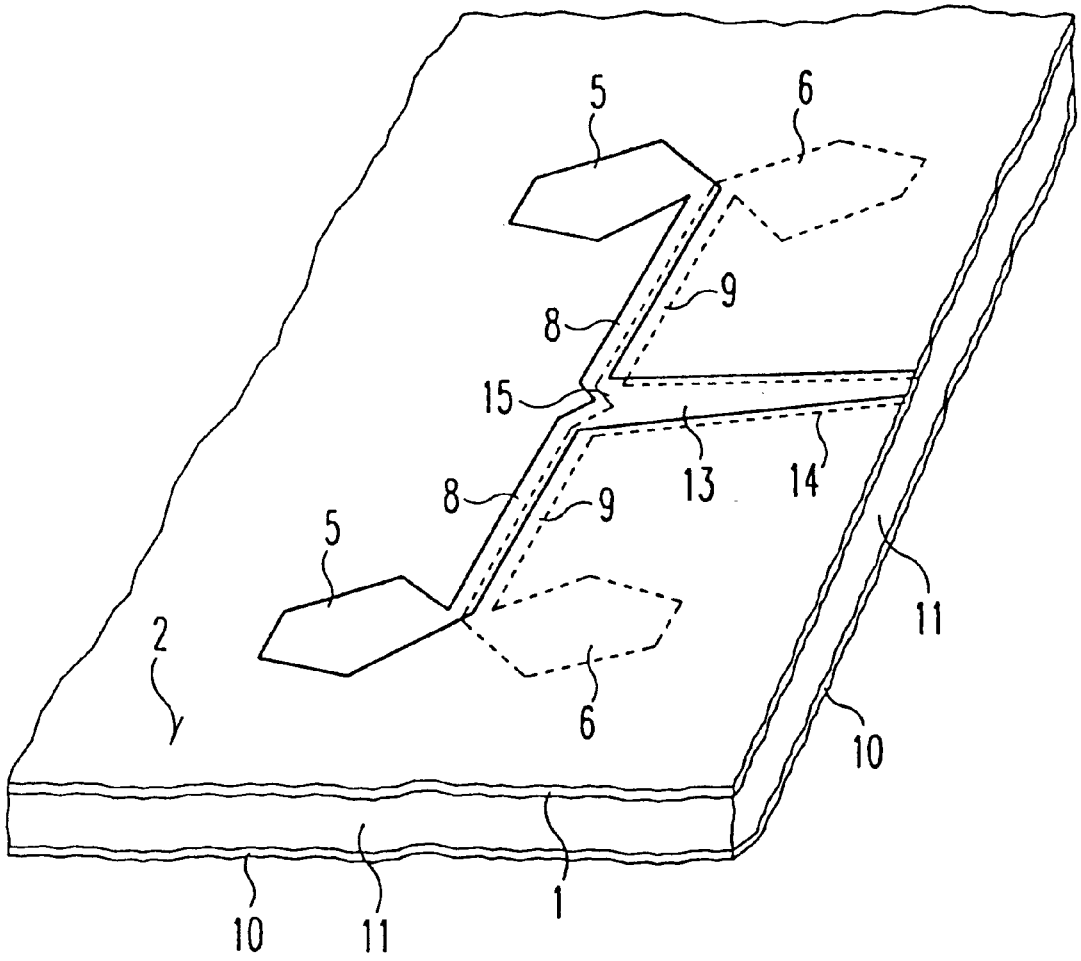
FIG. 2 shows a perspective view of a portion of the antenna shown in FIG. 1.

In FIG. 2, the schematic perspective view of a portion of the antenna shown in FIG. 1 having two dipoles is shown. The antenna comprises a substrate 1 having a front face 2 and a back face 3. The first elements 5 are printed on the front face 2 and the second elements 6 are printed on the back face 3. Also, the first lines 8 are printed on the front face 2 and the second lines 9 are printed on the back face 3. In FIG. 2, only two dipole means 4 are shown, which are fed by first and second lines 8, 9. The T-junction 15 between the two shown dipole means 4 is fed by a first line portion 13 on the front face 2 and a second line portion 14 on the back face 3. The first and the second line portion 13, 14 are tapered with an increasing width towards the dipole means 4. The tapering provides an impedance transition from 100 Ω at the narrow part of the first and the second line portion 13, 14 to 50 Ω at the large part of the first and the second line portion 13, 14. At the T-junction the first and second line portion 13, 14 are split into the not-tapered end portions of the first and the second line 8, 9 leading to the dipole means 4. The low loss material 11 between the dielectric substrate 1 and the reflector means 10 is chosen to have minimum losses and a dielectric constant less than 1.2. In the shown example, the low loss material 11 is a supporting structure supporting said reflector means 10 and said dielectric substrate on its back face 3. In other embodiments, the loss material 11 can be air, so that a free space exists between the dielectric substrate 1 and the reflector means 10. Advantageously, the low loss material is a polyurethane foam. However, the low loss material can be any other material with a dielectric constant less than 1.2. By a variation of the low loss material 11 the thickness of the dipole antenna can be influenced. In FIG. 2, dashed lines are used to show the second element 6 and the second line 9 being printed on the back face 3 of the dielectric substrate 1.

Figure 3:
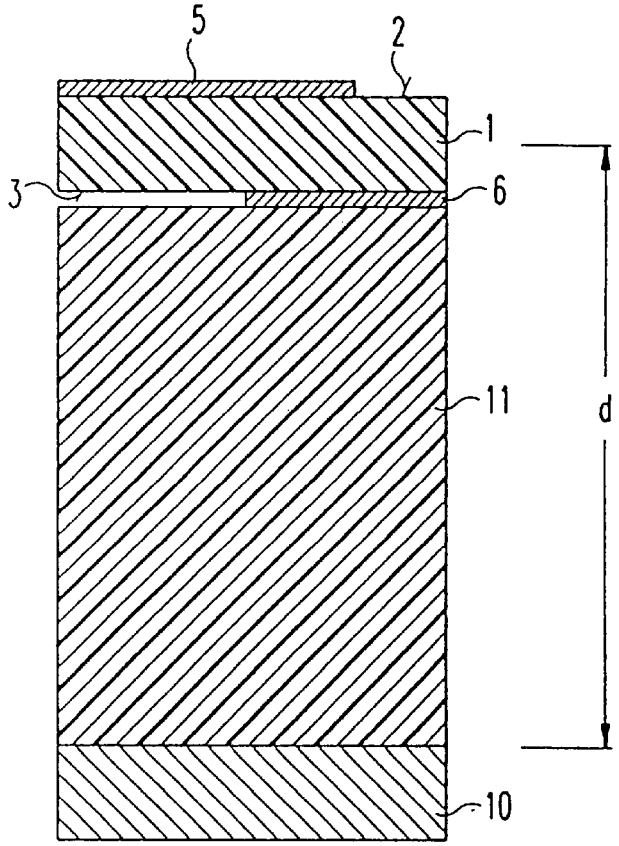
FIG. 3 shows a cross-sectional view explaining the structure of the antenna according to the present invention.

In FIG. 3 a cross section of the antenna according to the present invention is shown. A first element 5 is printed on the front face 2 of the dielectric substrate 1, and the second element 6 is printed on the back face 3 of the dielectric substrate 1. The dielectric substrate with the second elements 6 and the second lines 9 printed thereon is supported by a low loss material 11 building a supporting structure. On the face of the low loss material 11 opposite to the back face 3 of the dielectric substrate 1, a reflector means 10 is located.

The reflector means shown is a reflector plate parallel to said back face. The distance d between the upper face of the reflector means 10 and the middle of the dielectric substrate 1 is about one fourth of the electrical wave length λ of the central frequency (middle of the working band) within the low loss material dealing as a support structure between the dielectric layer 1 and the reflector means 10. Advantageously, the distance d is $\lambda/(4\times\mathrm{sqrt}(\epsilon_r))\pm10\%$, wherein $\epsilon_r$ is the dielectric constant of the low loss material. A slight change of the distance d can cause special effects in the radiation pattern of the dipole antenna, which are sometimes wanted. Further on, the antenna of the shown embodiment has a planar shape, whereby other shapes of the antenna according to the present invention might be used.

Figure 4:
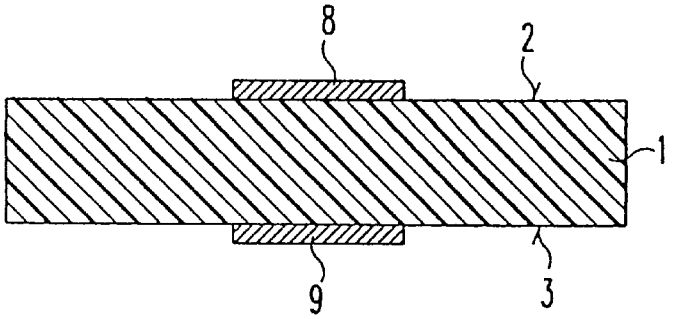
FIG. 4 shows a cross-sectional view of an upper part of the antenna according to the present invention explaining the balanced metal strip lines.

In FIG. 4, a cross section of the dielectric substrate 1 with the first line 8 and the second line 9 printed on the front face 2 and the back face 3, respectively, is shown. As can be seen from FIG. 4, the first line 8 and the second line 9 are balanced and arranged parallel and opposite to each other on the front and the back face 2, 3, respectively. The width and the shape of the first line 8 and the second line 9 are the same. It is to be noted, that the whole feeding network in form of the metal strip means 7 is realized by balanced metal strip lines being parallel and opposite to each other. The symmetry axis of the first line 8 and the second line 9 lies within the middle plane of the dielectric substrate 1. The T-junctions 15 are provided to distribute the signals to and from the plurality of dipole means 4. The T-junctions 15 of the first line 8 and the second line 9 are also balanced T-junctions and respectively arranged parallel and opposite to each other on said front and back face 2, 3, respectively. Further on, the T-junctions can be provided with a triangular gap in order to compensate the influence of the junction discontinuity, as can be seen e.g. in the T-junction 15 shown in FIG. 2.

In order to integrate the antenna according to the present invention with a necessary front-end, a transmission line transition between the balanced metal strip lines according to the present invention to the transmission line technology of the front-end is necessary. If waveguide technology is used in the front-end, a waveguide transition element 12 shown in FIG. 1 can be used. If the front-end utilizes a microstrip technology, a microstrip to balanced microstrip transition should be used. If the front-end utilizes a coplanar waveguide technology, a coplanar waveguide to a balanced microstrip transition has to be used. If the front-end utilizes coaxial lines, a coaxial connector to balanced microstrip transition has to be used.

Due to the ultra-wide-band operability of the antenna according to the present invention and commercially available dielectric substrate thicknesses a whole frequency coverage up to 140 GHz and more can be obtained without need to change the structure of the antenna according to the present invention. Simple up-scaling and down-scaling the antenna of the present invention allows the application for higher and lower frequency ranges without the recalculation of the dipole antenna structure.

Figure 5:
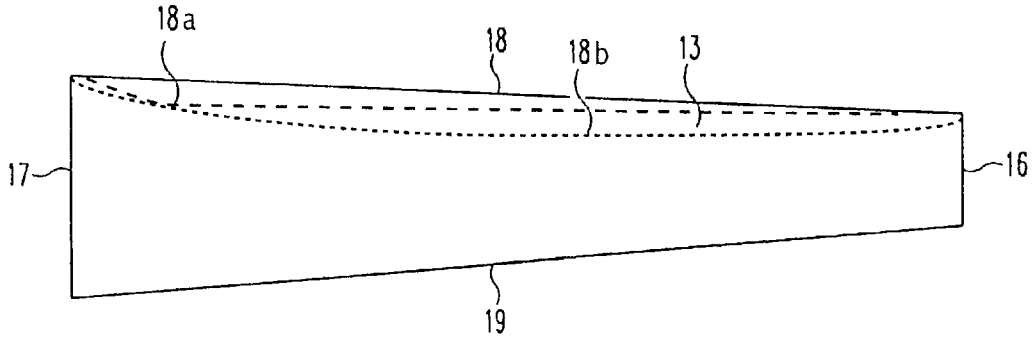
FIG. 5 shows a schematic view of a portion of a metal strip line having a tapered shape.

In FIG. 5, a first line portion 13 is shown to explain the tapered shape of the line portions between two adjacent T-junctions 15. The small end 16 of the shown line portion is connected to a T-junction 15 in direction to a transition element, e.g. the waveguide transition element 12 shown in FIG. 1, whereas the long side 17 is connected to a T-junction 15 in direction to the dipole means 4. The width of the side portion increases from the small end 16 to the large end 17 to provide an impedance transformation from 100 Ω to 2×50 Ω in the T-junction connected with the long end 17. To provide the impedance transformation from 100 Ω to 50 Ω, the width of the line portion gradually increases to provide an impedance transformation of a ratio 1:2 in the succeeding T-junction 15. The tapering of the balanced line portions 13 and 14 is actually smooth, whereby the width of the lines on the front face 2 and the back face 3 of the dielectric substrate 1 is changed simultaneously. A change of the width of the line portions changes the impedance of the transmission lines. The above statements are equally true for the second line portions 14.

The side portions 18 and 19 of the line portions can change with a linear function, as in the example shown in FIG. 5. In other embodiments, the side portions 18 and 19 can change with an exponential function 18*a* or a polynomial function 18*b* including a "Chebisshev Polinom". The choice of the respective tapering function depends on the respective working frequency and is made to have a minimal reflectivity in the line portions. The tapering of the line portions is advantageous over the known quarter-wave transformers because of the high frequency selectivity and high tolerance dependency of the quarter-wave transformer. Further on, the balanced metal strip structure is advantageous over known microstrip structures, since transitions to other printed structures over waveguides, e.g. in a front-end, can be obtained much easier. Also, using a dielectric substrate 1 with a constant thickness, the higher order modes propagation, which is a very undesired effect, appear in known unbalanced microstrip lines at lower frequencies than in the balanced metal strip lines according to the present invention.

Figure 6:
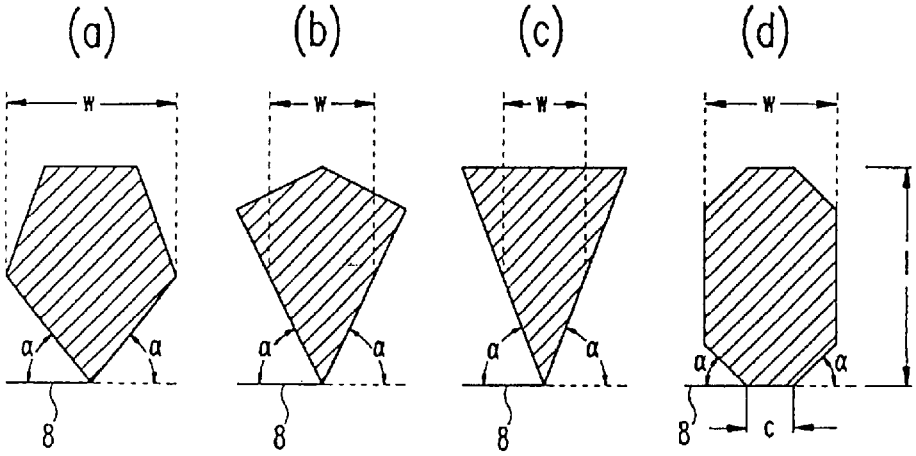
FIG. 6 shows four different possible shapes of the dipole elements.

In FIG. 6, four different shapes for the first elements 5 and the second elements 6 of the dipole means 4 are shown. All the shown shapes are showing very good matching and radiating performances within more than 50% band around the central frequency as well as applicability for microwave and mm-wave range due to the not so critical tolerances. However, the pentagonal shape shown in FIG. 6 *a* shows the best performances and is the preferred shape for the antenna according to the present invention. Preferably, the first and second elements 5, 6 have a structure comprising at least three corners and one of the corners is the contact area between the respective line portion 13 or 14 and the element 5 or 6.

In FIG. 6 *b*, the element 5 or 6 has four corners with two long sides adjacent to the corner building the contact area and two short sides opposite to said two long sides. In FIG. 6 *b*, the element 5 or 6 has three corners. In FIG. 6 *d*, the element 5 or 6 has eight corners having two long opposite sides, respectively two middle sides adjacent to said long sides, and two short sides opposite to each other and rectangular to said long sides. One of the two short sides is the contact area to the respective line portion, as can be seen in FIG. 6 *d*.

Advantageously, the length l of said first and second elements 5, 6 is respectively smaller than 0.5 λ, the mean width w is smaller than 0.35 λ and the width c of a contact area between said respective element and said first or second line 8, 9 coupled to said respective element is smaller than 0.1 λ, wherein λ is a free space wavelength of the centered frequency band of interest. The mean width w is defined as the width of the respective element 5, 6 at the half of the length 1, as can be seen in FIG. 6. In FIGS. 6 *a*, 6 *b* and 6 *c* the contact area width c is zero, since one of the corners of the respective elements 5, 6 is the contact area, whereas in FIG. 6 *d*, the contact area width c is the length of one of the short sides of the element 23. Further on, the angle α between the respective line 8, 9 and the sides of the element adjacent to said contact area is preferably larger than 10°. Elements 5, 6 with shapes as shown in FIG. 6 and having the above defined characteristics are elements 5, 6 which can successfully work in frequency bands of at least 30%, typically 40–50%, related to the center frequency, having a VSWR less than 2. It is to be noted, that such elements 5, 6 can cover with a VSWR less than 2.5 even more than one octave.

A phase array antenna according to the present invention designed to work at a center frequency of 60 GHz preferably has 64 dipole means, a dielectric substrate with a thickness of 0.127 mm and a dielectric constant of 2.22 (Teflon-fiberglass), a metallization thickness for the printed lines and elements of 17 μm, a low loss material of polyurethane with a dielectric constant of 1.03 as a support material and a planar to waveguide (WR-15) transition to a RF front-end. The dimensions of such an antenna are preferably as given in FIGS. 7 and 8. For the frequency range of 94 GHz a thinner substrate is recommended. The final trimming of the antenna dimensions particularly for higher frequencies should be done by a full wave electromagnetic simulator, if not direct scaling is applied. It is possible, by changing of the in-face feeding network to obtain a reduction of the side lobes at specified frequencies using the same structure for the antenna according to the present invention. The number of used dipole elements can be increased and decreased. One solution could be to use the power of 4 for decreasing and increasing the number of elements (such as 4, 16, 64, 256). With 256 elements at 60 GHz the feasible gain value is estimated about 18 dB. A larger number of elements will increase the directivity but not necessarily the gain, because of losses in the longer transmission lines and will lead to a larger surface, which could be impractical.

Figure 7:
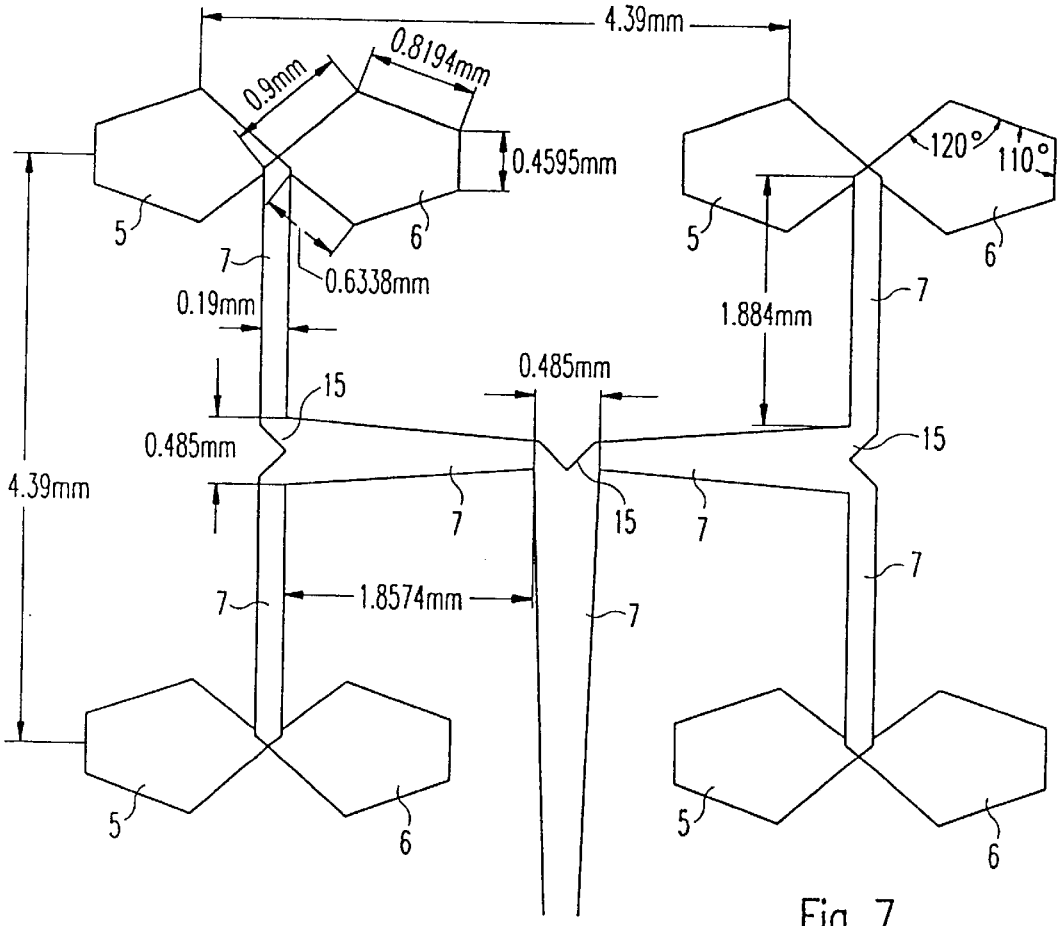
FIG. 7 shows a schematic top view of a part of multiple printed dipole elements with preferred dimensions.

FIG. 7 shows a top view of some of the multiple elements 5, 6 projected into one common plane having preferred dimensions. All the preferred dimensions given in FIG. 7 are in millimeters. As has been stated above and is shown in FIG. 7, the preferred shape of the elements 5, 6 is a pentagonal shape having 5 corners. One of the corners respectively is the contact area between the pentagonal elements 5, 6 and the first and second lines 8, 9. The first elements 5 point in a first direction and the second elements 6 point in a second direction opposite to said first direction. The first and the second direction are perpendicular to the length direction of the lines 8, 9. The inner side of the pentagonal elements 5, 6 adjacent to the corner building the contact area has a length of 0.6338 mm and the outer side of the elements has a length of 0.9 mm. The end side of the pentagonal elements 5, 6 opposite to the corner building the contact area has a length of 0.4595 mm, whereas the two sides between the end side and the sides adjacent to said contact area have a length of 0.8194 mm. The width of the first and second lines between the last T-junction 15 and the first and second elements 5, 6 have a constant width of 0.19 mm and a length of 1.884 mm from said T-junction 15 to the contact area. The width of the T-junctions 15 is 0.485 mm, which is also the width of the first and second line portions 13, 14 at the T-junctions 15 in direction to the elements 5, 6. The distance between the first and second lines 8, 9 contacting the elements 5, 6 and the parallel first and second line portions 13, 14 is 1.8574 mm. The distance between the middle axis of adjacent elements 5, 6 being coupled to the same T-junction 15 is 4.39 mm. The inner angle of the corner of the pentagonal elements 5, 6 building the contact area is less than 70°, the inner angle of the two corners adjacent to the corner building the contact area is approximately 120° and the two angles opposite to the angle building the contact area is approximately 110°. The distance between two first or second elements 5, 6 respectively, being adjacent in the length direction of the elements and coupled over three T-junctions 15 is 4.39 mm, measured between two respective corners having inner angles of approximately 120°. Therefore, respective elements 5, 6 are equidistant from one another.

Figure 8:
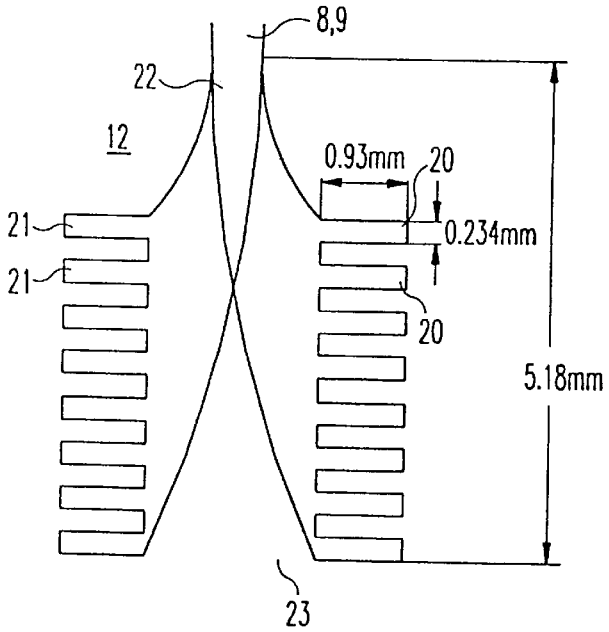
FIG. 8 shows a schematic top view of a transition element for the transition between balanced microstrips to a waveguide with preferred dimensions.

In FIG. 8, a top view of a waveguide transition element 12 is shown with preferred dimensions. The waveguide transition element 12 provides a transition between the balanced metal strips 5, 6 to a waveguide, e.g. WR-15. The waveguide transition element 12 provides a plurality of teeth-like elements 20, 21 for each of the metal strip lines 8, 9, the teeth-like elements 20, 21 pointing in respective directions perpendicular to said metal strip lines 8, 9. The teeth-like elements 20 allocated to the first metal strip line point in a first direction and the teeth-like elements 21 allocated to the second metal strip line 9 point in a second direction opposite to said first direction. The length of the teeth-like elements is 0.93 mm and their width is 0.234 mm. The overall length of the waveguide transition element 12 from the first side 22 coupled to the metal strip lines 8, 9 and the second side 23 coupled to the waveguide is 5.18 mm. It is to be noted, that all of the preferred dimensions given in the FIGS. 7 and 8 are adopted to an antenna working at a center frequency of 60 GHz, whereby the major of the dimensions are up- and down-scaleable taking into account the center frequency of 60 GHz.

Figure 9:
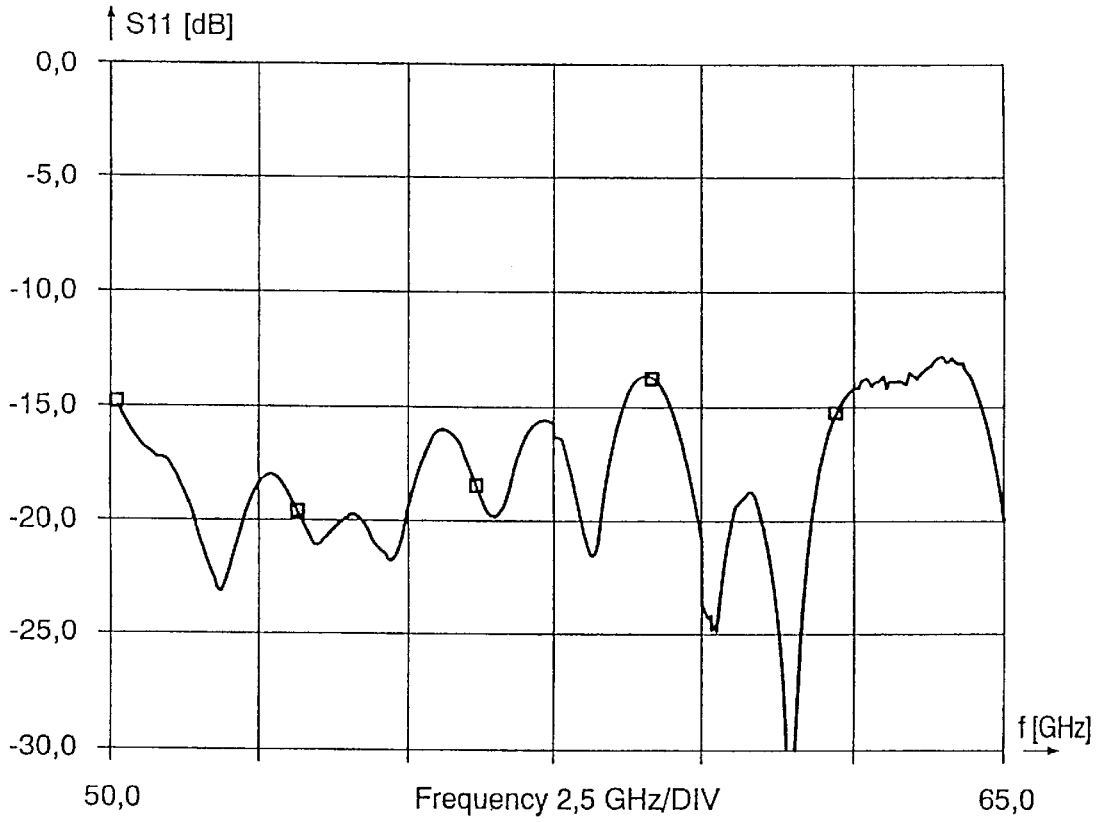
FIG. 9 shows a diagram with the measured input reflection coefficient of a multiplied dipole antenna assembled into a plane array according to the present invention.

In FIG. 9, the input reflection coefficient of the antenna (S11 in dB) over a frequency band from 50.0 to 65.0 GHz is presented for an antenna according to the present invention. As can be seen in FIG. 9, the antenna according to the present invention shows excellent values despite a frequency selective waveguide transition from the front end to the balanced metal strip lines of the feeder of the antenna according to the present invention. The input reflection coefficient of the antenna according to the present invention does not exceed −13 dB in the range of the measurement, or leads to a VSWR maximum value of 1.58. As can be seen in FIG. 9, in a range between 50.0 and 65 GHz similar values of S11 have been found, meaning at least 30% working range. Measurements in larger bands were not possible due to the limited frequency band of the used waveguide (WR-15.50 −70 GHz).

Figure 10:
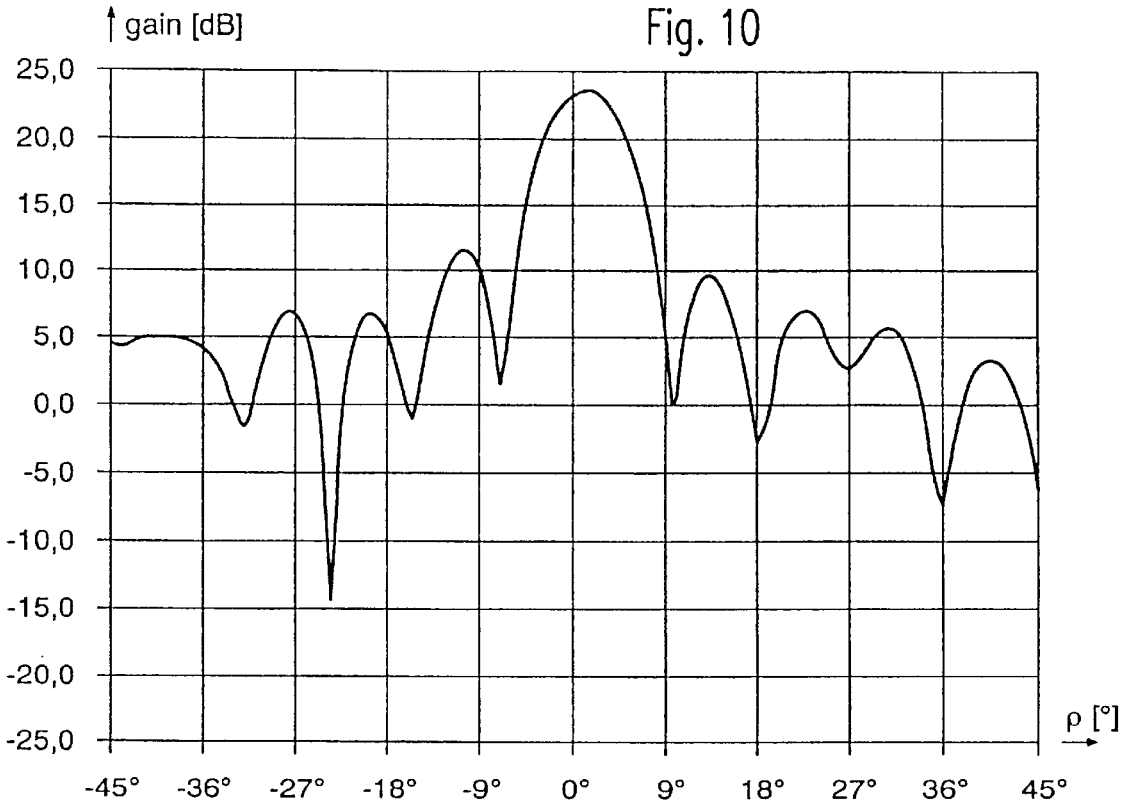
FIG. 10 shows a measure diagram of the gain of a phase array antenna according to the present invention at 60 GHz for the main horizontal plane.

In FIG. 10, a measured antenna diagram at 60 GHz for the main horizontal plane for an antenna according to the present invention is shown. The diagram shown in FIG. 10 shows the gain of the antenna according to the present invention in dB over the radiation angle $\phi$ between −45° and +45°. The measurement was performed in comparison to a well-known horn-antenna. The light non-symmetrical behavior of the shown diagram is up to non-perfect measurement equipment. The measured antenna gain is 23.5 dB vs. about 26.5 dB estimated (simulation) directivity, leading to overall losses of about 3 to 3.5 dB including losses due to the waveguide to balanced metal strip transition, which is a very good value. There is almost no change of the antenna diagram over the whole measured frequency range of 50–65 GHz. The maximum gain ripple in the measured range does not exceed 1 dB, which shows the excellent performance of the dipole antenna according to the present invention.

The antenna array is fed in phase, so that side lobes of −13 dB to the main lobe should appear. In all of the measured cases (50–65 GHz), the side lobes did not exceed −10 to −11 dB of the carrier strength. If a "different phase" feeding is applied, the side lobes can be influenced directly. This is achieved by changing the length of the feeding lines approaching the printed dipoles from outside of the printed patch to the phase center (middle of the antenna) with predefined mathematical functions.

Figure 11:
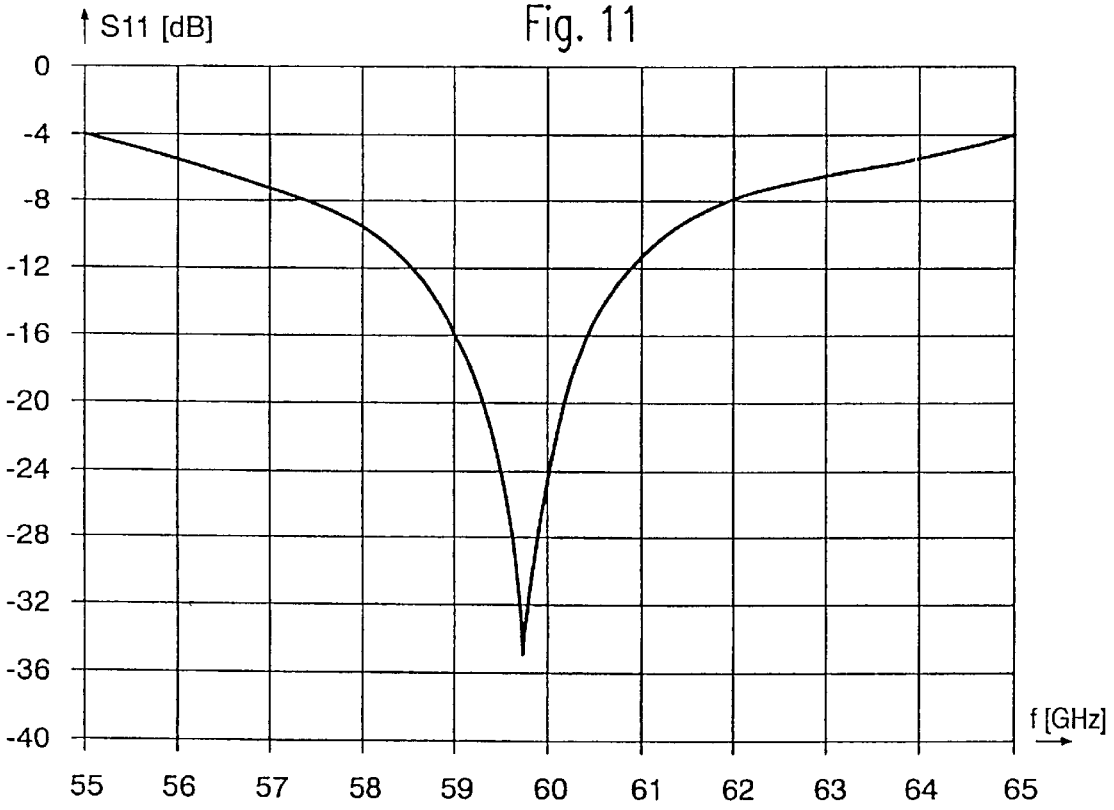
FIG. 11 shows a measure diagram of the gain of a known microstrip patch antenna.

In order to show the outstanding capability of the antenna according to the present invention an input reflection diagram of a simple radiation element (microstrip patch) is compared to the proposed high-gain solution according to the present invention. The input reflection coefficient (S11 in dB) of a microstrip patch antenna designed to 61.5 GHz is shown in FIG. 11. The measured microstrip patch antenna is a low-cost antenna with a very high tolerance sensitivity showing large problems with the feeding of signals, if high gain application with a plurality of elements at very high frequencies are applied.

Figure 12:
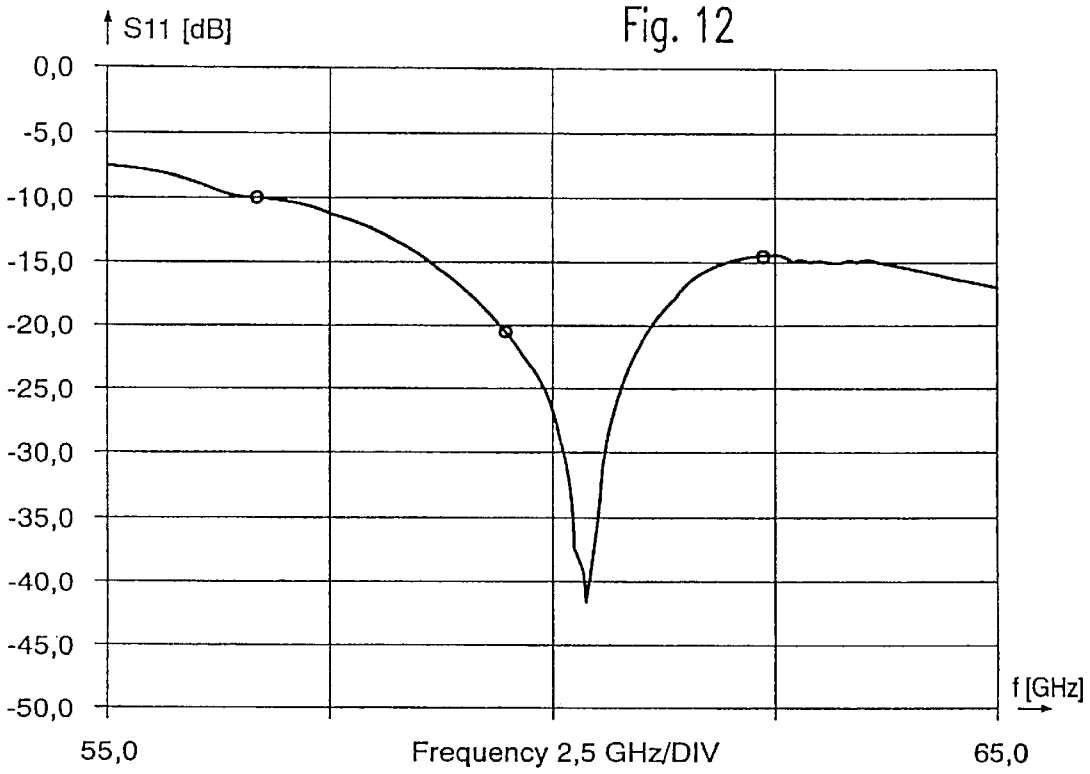
FIG. 12 shows a measure diagram of the input reflection coefficient of a known monopole antenna.

In FIG. 12, the input reflection coefficient (S11 in dB) of a known monopole antenna designed to 61.5 GHz was measured without a radome. The measured monopole antenna showed a very high tolerance sensitivity, only a small gain and no high gain features. Also, the reproducibility and the shadowing in the elevation angle of 90° of the measured monopole antenna was very critical.

Figure 13:
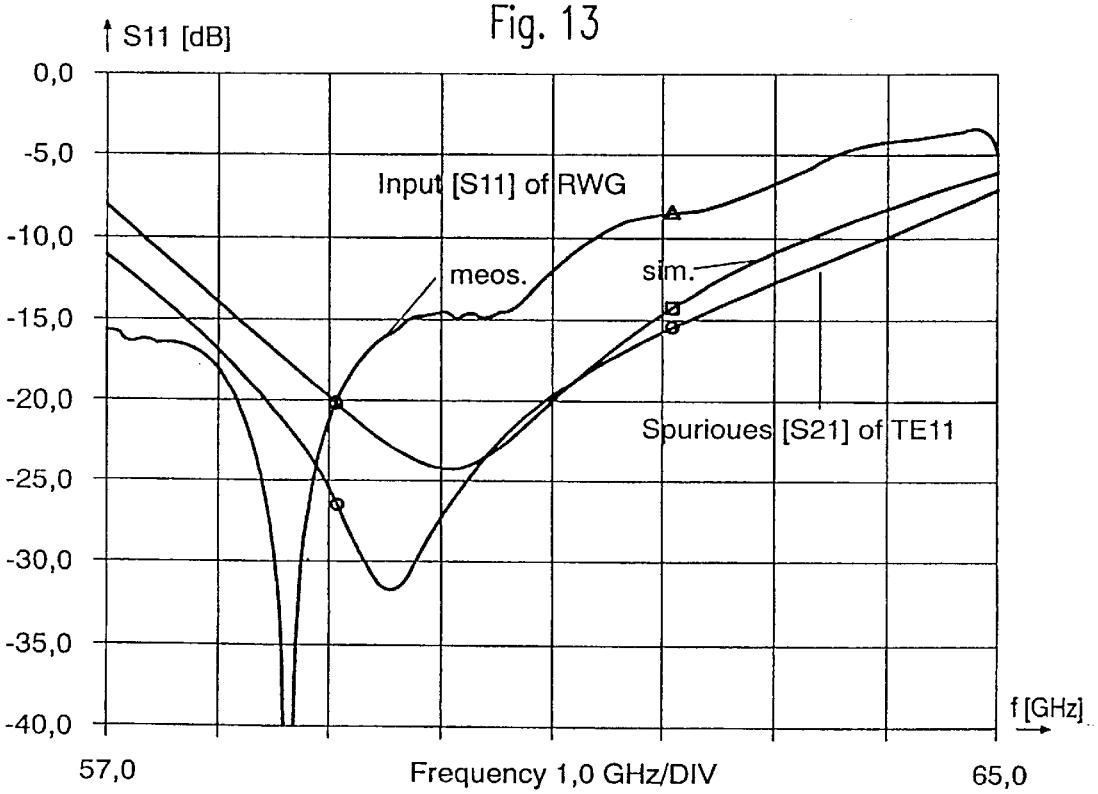
FIG. 13 shows a measure diagram of the input reflection coefficient of a known dielectric lens antenna.

In FIG. 13, one measured and two simulated curves for the input reflection coefficient (S11 in dB) of a dielectric lens antenna in the frequency range of 57.0 to 65.0 GHz are shown. The two smooth curves are the simulated curves whereas the third curve showing a sharp drop at 58.7 GHz is the measured dielectric lens antenna. The measured dielectric lens antenna required at the moment waveguide feeders, which are large (diameter 8 cm) for 60 GHz and are quite expensive featuring more or less only low gain remote station (base station) applicability in the 60 GHz range.

As can be seen from the shown diagrams, the antenna according to the present invention has an excellent performance even at very high frequencies. The antenna of the present invention can be produced as a low-cost low gain antenna as well as a high gain antenna for all kinds of purposes in the microwave and in the millimeter wave range. The antenna according to the present invention can be successfully used for microwave and millimeter wave wireless LANs and private short data links, as well as for automotive radar applications, where low-cost planar solutions are required. Moreover, this antenna can cover a whole band planned for millimeter wave wireless LANs 59–64 GHz, and the two bands planned for anti-collision (automotive, car) radars in Europe and the USA (76 GHz) and Japan (61 GHz), simultaneously.

We claim:

1. A phase array antenna, comprising a dielectric substrate (1) comprising a front and a back dielectric face (2,3), a plurality of dipole means (4), each comprising a first and a second element (5, 6) for radiating and receiving electromagnetic signals, said first elements (5) being printed on said front face and pointing in a first direction and said second elements (6) being printed on said back face (3) and pointing in a second direction opposite to said first direction, metal strip means (7) for supplying signals to and from said dipole means (4), said metal strip means (7) comprising a first line (8) printed on said front face (2) and coupled to said first element (5) and a second line (9) printed on said back face (3) and coupled to said second element (6), and reflector means (10) spaced to and parallel with said back face (3) of said dielectric substrate (1), a low loss material (11) being located between said reflector means (10) and said back face (3) and having a dielectric constant less than 1.2, whereby said first and second lines (8, 9) respectively comprise a plurality of first and second line portions (13, 14), said first and second line portions (13, 14) respectively being connected to each other by T-junctions (15), whereby each of said first and second line portions (13, 14) is tapered between two adjacent T-junctions (15), so that the width of each line portion (13, 14) increases towards said first and second elements (5, 6), respectively, and said line portions are tapered corresponding a linear function to provide an impedance transformation in the succeeding T-junction (15).

2. A phase array antenna according to claim 1, characterized in, that the width of each of the line portions (13, 14) gradually increases to provide an impedance transformation of a ratio one to two in the succeeding T-junction (15).

3. A phase array antenna according to claim 1, characterized in that said low loss material (11) is a supporting structure supporting said reflector means (10) and said back dielectric face (3).

4. A phase array antenna according to claim 1, characterized in that said first and said second lines (8, 9) and said T-junctions (15) are balanced and arranged parallel and opposite to each other on said front and back dielectric face (2, 3), respectively.

5. A phase array antenna according to claim 1, characterized in, that the length (l) of said first and second elements (5, 6) is respectively smaller than 0.5 $\lambda$ the mean width (w) of the respective element is smaller than 0.35 $\lambda$ and the width (c) of a contact area between said respective element and said first or second line (8, 9) coupled to said respective element is smaller than 0.1 $\lambda$, whereby $\lambda$ is the free space wavelength of the center frequency of the band of interest, the angle between the respective line (8,9) and each of the adjacent sides of the respective element (5,6) being larger than 10 degrees.

6. A phase array antenna according to claim 5, characterized in, that said first and second elements (5, 6) have a structure comprising at least three corners and that said contact area is one of said corners.

7. A phase array antenna according to claim 5, characterized in, that said first and second elements (5, 6) have a pentagonal shape.

8. A phase array antenna according to claim 1, characterized in, that the distance (d) of the reflector means (10) to the middle of said dielectric substrate means (1) is approximately one fourth of the electrical wavelength of the working band frequency within said low loss material (11).

9. A phase array antenna according to claim 1, characterized by a transition element (12) coupled to said first and second lines (8,9) to provide a transition between said first and second lines (8,9) and a waveguide for guiding signals to and from the antenna, said transition element (12) comprising first teeth elements (22) coupled to said first line (8) and second teeth elements (22) coupled to said second line (9), said first teeth elements pointing in a first direction and said second teeth elements pointing in a second direction opposite to said first direction, said first and said second direction being perpendicular to said first and second lines (8,9).

10. Antenna, comprising a dielectric substrate (1) comprising a front and a back dielectric face (2, 3), at least one dipole means (4) comprising a first and a second element (5, 6) for radiating and receiving electromagnetic signals, said first element (5) being printed on said front face and said second element (6) being printed on said back face (3), said first element (5) pointing in a first direction and said second element (6) pointing in a second direction opposite to said first direction metal strip means (7) for supplying signals to and from said dipole means (4), said metal strip means (7) comprising a first line (8) printed on said front face (2) and coupled to said first element (5) and a second line (9) printed on said back face (3) and coupled to said second element (6), and reflector means (10) spaced to and parallel with said back face (3) of said dielectric substrate (1), a low loss material (11) being located between said reflector means (10) and said back face (3), and having a dielectric constant less than 1.2, characterized in, that said first and second lines (8, 9) are balanced and arranged parallel and opposite to each other on said front and back dielectric face (2, 3), respectively and said first and second lines (8, 9) comprising a plurality of first and second line portions (13, 14), said first and second line portions (13, 14) being connected to each other by T-junctions (15), and tapered between two adjacent T-junctions (15) so that the width of each line portion (13, 14) increases towards said first and second elements (5, 6), respectively, and said first and second line portions are tapered corresponding a linear function to provide an impedance transformation in the succeeding T-junction.

11. Antenna according to claim 10, characterized in that said low loss material (11) is a supporting structure supporting said reflector means (10) and said back dielectric face (3).

12. Antenna according to claim 10, characterized in, that the width of each of the line portions (13, 14) gradually increases to provide an impedance transformation of a ratio one to two in the succeeding T-junction (15).

13. Antenna according to claim 10, characterized in, that the length (l) of said first and second elements (5, 6) is respectively smaller than 0.5 λ the mean width (w) of the respective element is smaller than 0.35 λ and the width (c) of a contact area between said respective element and said first or second line (8, 9) coupled to said respective element is smaller than 0.1 λ, whereby λ is the free space wavelength of the center frequency of the band of interest, the angle between the respective line (8,9) and each of the adjacent sides of the respective element (5,6) being larger than 10 degrees.

14. Antenna according to claim 13, characterized in, that said first and second elements (5, 6) have a structure comprising at least three corners and that said contact area is one of said corners.

15. Antenna according to claim 13, characterized in, that said first and second elements (5, 6) have a pentagonal shape.

16. Antenna according to claim 10, characterized in, that the distance (d) of the reflector means (10) to the middle of said dielectric substrate means (1) is approximately one fourth of the electrical wavelength of the working band frequency within said low loss material (11).

17. Antenna according to claim 10, characterized by a transition element (12) coupled to said first and second lines (8,9) to provide a transition between said first and second lines (8,9) and a waveguide for guiding signals to and from the antenna, said transition element (12) comprising first teeth elements (22) coupled to said first line (8) and second teeth elements (22) coupled to said second line (9), said first teeth elements pointing in a first direction and said second teeth elements pointing in a second direction opposite to said first direction, said first and said second direction being perpendicular to said first and second lines (8,9).

18. A phase array antenna, comprising a dielectric substrate comprising a front and a back dielectric face (2,3), a plurality of dipole means, each comprising a first and a second element for radiating and receiving electromagnetic signals, said first elements being printed on said front face and pointing in a first direction and said second elements being printed on said back face (3) and pointing in a second direction opposite to said first direction, metal strip means for supplying signals to and from said dipole means, said metal strip means comprising a first line printed on said front face and coupled to said first element and a second line printed on said back face and coupled to said second element, and reflector means spaced to and parallel with said back face of said dielectric substrate, a low loss material being located between said reflector means and said back face and having a dielectric constant less than 1.2, whereby said first and second lines respectively comprise a plurality of first and second line portions, said first and second line portions respectively being connected to each other by T-junctions, whereby each of said first and second line portions are tapered between two adjacent T-junctions, so that the width of each line portion increases towards said first and second elements, and said first and second portions are tapered corresponding a exponential function to provide an impedance transformation in the succeeding T-junction.

19. A phase array antenna, comprising a dielectric substrate comprising a front and a back dielectric face (2,3), a plurality of dipole means, each comprising a first and a second element (5, 6) for radiating and receiving electromagnetic signals, said first elements being printed on said front face and pointing in a first direction and said second elements being printed on said back face and pointing in a second direction opposite to said first direction, metal strip means for supplying signals to and from said dipole means, said metal strip means comprising a first line printed on said front face and coupled to said first element and a second line printed on said back face and coupled to said second element, and reflector means spaced to and parallel with said back face of said dielectric substrate, a low loss material being located between said reflector means and said back face and having a dielectric constant less than 1.2, whereby said first and second lines respectively comprise a plurality of first and second line portions, said first and second line portions respectively being connected to each other by T-junctions, whereby each of said first and second line portions is tapered between two adjacent T-junctions, so that the width of each line portion increases towards said first and second elements, respectively, and said first and second line portions are tapered corresponding a polynomial function to provide an impedance transformation in the succeeding T-junction.

20. Antenna, comprising a dielectric substrate comprising a front and a back dielectric face, at least one dipole means comprising a first and a second element for radiating and receiving electromagnetic signals, said first element being printed on said front face and said second element being printed on said back face, said first elements pointing in a first direction and said second elements pointing in a second direction opposite to said first direction metal strip means for supplying signals to and from said dipole means, said metal strip means comprising a first line printed on said front face and coupled to said first element and a second line printed on said back face and coupled to said second element, and reflector means spaced to and parallel with said back face of said dielectric substrate, a low loss material being located between said reflector means and said back face, and having a dielectric constant less than 1.2, characterized in, that said first and second lines are balanced and arranged parallel and opposite to each other on said front and back dielectric face, respectively and said first and second lines respectively comprise a plurality of first and second line portions, said first and second line portions respectively being connected to each other by T-junctions, and being tapered between tow adjacent T-junctions so that the width of each line portion increases towards said first and second elements, respectively, and said first and second line portions are tapered corresponding an exponential function to provide an impedance transformation in the succeeding T-junction.

21. Antenna, comprising a dielectric substrate comprising a front and a back dielectric face, at least one dipole means comprising a first and a second element for radiating and receiving electromagnetic signals, said first element being printed on said front face and said second element being printed on said back face, said first elements pointing in a first direction and said second elements pointing in a second direction opposite to said first direction metal strip means for supplying signals to and from said dipole means, said metal strip means comprising a first line printed on said front face and coupled to said first element and a second line printed on said back face and coupled to said second element, and reflector means spaced to and parallel with said back face of said dielectric substrate, a low loss material being located between said reflector means and said back face, and having a dielectric constant less than 1.2, characterized in, that said first and second lines are balanced and arranged parallel and opposite to each other on said front and back dielectric face, respectively and said first and second lines respectively comprising a plurality of first and second line portions, said first and second line portions respectively being connected to each other by T-junctions, and being tapered between two adjacent T-junctions so that the width of each line portion increases towards said first and second elements, respectively, and said first and second line portions are tapered corresponding a polynomial function to provide an impedance transformation in the succeeding T-junction.

* * * * *